US009506151B2

(12) United States Patent
Nittel et al.

(10) Patent No.: US 9,506,151 B2
(45) Date of Patent: Nov. 29, 2016

(54) METHOD FOR APPLYING MANGANESE PHOSPHATE LAYERS

(75) Inventors: Klaus-Dieter Nittel, Frankfurt am Main (DE); Detlev Seifert, Munster (DE); Ralf Stickler, Kahl am Main (DE)

(73) Assignee: Chemetall GmbH, Frankfurt am Main (DE)

( * ) Notice: Subject to any disclaimer, the term of this patent is extended or adjusted under 35 U.S.C. 154(b) by 139 days.

(21) Appl. No.: 12/971,806

(22) Filed: Dec. 17, 2010

(65) Prior Publication Data

US 2011/0086171 A1 Apr. 14, 2011

Related U.S. Application Data

(63) Continuation of application No. 10/830,181, filed on Apr. 22, 2004, now abandoned, which is a continuation of application No. 10/088,840, filed as application No. PCT/EP00/09193 on Sep. 20, 2000, now abandoned.

(30) Foreign Application Priority Data

Sep. 30, 1999 (DE) ..... 199 47 232

(51) Int. Cl.
*C23C 22/18* (2006.01)
*C23C 22/00* (2006.01)

(52) U.S. Cl.
CPC ..... *C23C 22/18* (2013.01); *C23C 22/188* (2013.01)

(58) Field of Classification Search
CPC ... C23C 22/18; C23C 22/182; C23C 22/184; C23C 22/186; C23C 22/188
USPC ..... 148/262
See application file for complete search history.

(56) References Cited

U.S. PATENT DOCUMENTS

| | | | | | |
|---|---|---|---|---|---|
| 2,295,545 | A | | 9/1942 | Wilfred et al. | |
| 2,375,468 | A | * | 5/1945 | Clifford et al. | 148/260 |
| 2,987,427 | A | | 6/1961 | Shaw | |
| 3,450,578 | A | | 6/1969 | Siemund et al. | |
| 3,767,476 | A | * | 10/1973 | Wagner et al. | 148/259 |
| 3,860,455 | A | * | 1/1975 | Hansen et al. | 148/262 |
| 4,012,351 | A | | 3/1977 | Hall et al. | |
| 4,824,490 | A | | 4/1989 | Oei et al. | |
| 5,795,408 | A | | 8/1998 | Bittner et al. | |

FOREIGN PATENT DOCUMENTS

| | | | | | |
|---|---|---|---|---|---|
| DE | 11 09 484 | B | | 6/1961 | |
| DE | 22 13 781 | A1 | | 9/1973 | |
| EP | 0 042 631 | A1 | | 12/1981 | |
| EP | 0 711 849 | A1 | | 5/1996 | |
| EP | 0711849 | | * | 5/1996 | C23C 22/18 |
| GB | 1 373 897 | A | | 11/1974 | |
| GB | 2 078 788 | A | | 1/1982 | |

OTHER PUBLICATIONS

Rausch "The Phosphating of Metals" (1974)—in German, (1990)—in English; Finishing Publ., selected pages.

* cited by examiner

*Primary Examiner* — Lois Zheng
(74) *Attorney, Agent, or Firm* — Jeremy J. Kliebert

(57) ABSTRACT

The invention relates to a method for applying manages phosphate layers to iron or steel surfaces using phosphating solutions containing manganese, phosphate, iron (II) ions as well as nitroguinidine, as well as its application to work-pieces that are subject to sliding friction.

5 Claims, No Drawings

METHOD FOR APPLYING MANGANESE PHOSPHATE LAYERS

This application is a continuation of application Ser. No. 10/830,181 filed Apr. 22, 2004 now abandoned, which is a continuation of application Ser. No. 10/088,840 filed Jul. 2, 2002 now abandoned, each of which is incorporated herein by reference, which is a §371 of PCDEP00/09193 filed Sep. 20, 2000, which claims priority from DE 199 47 232.7 filed Sep. 30, 1999.

The invention relates to a method for applying manganese phosphate layers to iron or steel surfaces using phosphating solutions containing manganese, phosphate, iron(II) ions as well as nitroguanidine, as well as its application to workpieces that are subjected to sliding friction.

On account of their high mechanical resistance, manganese phosphate layers have proved ideal for various applications, e.g. in order to reduce the friction of metal surfaces sliding on one another or to facilitate the cold forming of metals. However, relatively thick, coarsely crystalline layers were obtained with the manganese phosphate solutions that were initially commonly used, these layers being particularly disadvantageous if fine mechanical parts are to be treated. Numerous proposals have therefore been made with the object of producing thin, finely crystalline manganese phosphate layers. For example, it is known that an improvement in the phosphate layer can be obtained by adding condensed phosphates. Phosphating solutions based on manganese phosphate are however generally employed at high temperatures, which means that, as a result of the considerable hydrolysis that takes place at high temperatures, the effectiveness of the condensed phosphates rapidly falls and/or replenishment condensed phosphate has to be constantly added.

Another way of obtaining fine-grain phosphate layers is described in German Auslegeschrift 1109 484. Nitrate-containing phosphate solutions in which the amount of nitrate is in excess of the amount of phosphate are used for this purpose. The solutions should have a ratio of nitrate to phosphate of about 1.5-4.5:1. It has been found however that in many cases the intended effect is not achieved.

Furthermore, a method is known in which an increased amount of free acid in the phosphating solution is specifically employed in order to obtain particularly thin layers (DE-C-1246356). However, on account of their low surface density these layers can, in practice, only apply to special cases.

Finally it is known to add to a phosphating solution based on manganese phosphate or manganese-iron phosphate in which the concentrations with respect to manganese, iron (II), phosphate and nitrate ions lie within specific limits, proportionally more free $P_2O_5$ in relation to the total than corresponds to the phosphating equilibrium in the working phosphating solution. The aforementioned measure is said to have the advantages of achieving a significant decrease in the amount of slurry formed in the phosphating and a reduction of the chemicals needed to produce a specific amount of coating (DE-B-22 13781).

A common feature of the known methods is that manganese phosphate layers are formed having significant roughness depths. The reason for this is that the etching action in manganese phosphate systems is already pronounced at the start of the process and leads to a punctiform removal of metal after an extremely short action time. On the other hand, the layer formation takes place relatively slowly compared with zinc phosphate systems. The pronounced etching action and delayed layer formation can be observed visually by a large evolution of gas over a relatively long period, the so-called gas time.

The object of the invention is to provide a method that leads to manganese phosphate layers having as low a roughness depth as possible, but whose layer thickness is in the medium to high range.

This object is achieved by the method of the type mentioned in the introduction and corresponding to the invention in which, in order to produce a manganese phosphate layer, having a minimum, thickness of 2.5 μm and an averaged maximum roughness depth ($R_z$) of 2.5 μm, measured after drying, the workpieces are brought into contact with a phosphating solution containing 0.2 to 4 g/l of iron(II) ions
10 to 25 g/l of manganese ions
25 to 50 g/l of phosphate ions (calc. as $P_2O_5$)
3 to 35 g/l of nitrate ions
0.5 to 5 g/l of nitroguanidine that has 7 to 24 points of free acid, 50 to 140 points of total acid, as well as an S value of 0.2 to 1.

The averaged roughness depth is defined according to DIN 4768, Sheet 1, and represents the arithmetic mean of the individual roughness depths of five mutually adjoining individual measurement stretches of identical length, defined as $$R_z=0.2(Z_1+Z_2+Z_3+Z_4+Z_5)$$

The required maximum value of 2.5 μm refers only to the roughness depth of the manganese phosphate layer and disregards the depth of the untreated metal surface.

The aforementioned total point number is determined in a manner known per se by titrating 10 ml of the phosphating solution after dilution with water to about 50 ml using phenolphthalein as indicator, until the colour changes from colourless to red. The amount of 0.1 N sodium hydroxide solution used represents the total point number. Other suitable indicators for the titration are thymolphthalein and ortho-cresolphthalein.

The free acid points are determined in a similar way, dimethyl yellow being used as indicator and the titration being carried out until the colour changes from pink to yellow. Interfering metal ions are removed beforehand by adding hexacyanoferrate (II) or hexacyanocobaltate (III) ions. The S value is defined as the ratio of free $P_2O_5$ to total $P_2O_5$. (For further details see W. Rausch, "Die Phosphatierung von Metallen", Eugen G. Leuze Verlag, Stuttgart 1974, pp. 273 ff.).

More particularly, it is known from GE-A-510684 to produce manganese phosphate layers using phosphating solutions that may also contain nitroquanidine in addition to numerous other oxidising agents. However, it can be calculated from the data relating to the point numbers of free acid and total acid that the phosphating solutions contain considerably lower concentrations of phosphating-active components and—corresponding to the objective pursued in the known method of improving the corrosion resistance of metals—can form layers of a very low layer weight. The patent specification does not contain any kind of information on the roughness depth of the phosphate layer.

The investigations carried out on the development of the present invention have shown that when using nitrate as accelerator, which autocatalytically forms nitrite as a result of the normally used high phosphating temperatures, or when using nitrite or chlorate, the layer formation is disturbed because of the deficient iron(II) content, or layers are formed having only a very low layer weight or very low layer thickness. In contrast the use of nitroguanidine allows the iron(II) concentration to be kept below specific limits without resulting in an undesirable sharp drop in the iron(II) content necessary for the formation of a qualitatively high-grade layer.

In order to assist the oxidation of iron(II), oxygen-containing gas, for example compressed air, may be blown into the phosphating solution. Substances that oxidise iron(II), preferably potassium permanganate, may also be added. It should however be borne in mind that the iron(II) concentration should in no case fall below 0.2 g/l, since otherwise the desired layer weight will not be obtained.

A preferred embodiment of the invention envisages bringing the workpieces into contact with a phosphating solution that contains 0.5 to 2 g/l of nitroguanidine. Reasons of cost in particular are decisive in this connection.

Furthermore it is advantageous to adjust the concentration of iron(II) ions in the phosphating solution to a maximum concentration of 2.5 g/l. In this way, finely crystalline layers of small roughness depth can also reliably be formed in the case of workplaces that are difficult to phosphate.

If workpieces with steel surfaces are to be phosphated, a further advantageous embodiment of the invention envisages adding complex-forming agents to the phosphating solution in order to complex the alloying constituents of the steel. In particular chromium is such an alloying constituent. Suitable complex-forming agents are for example tartaric acid, but, in particular, citric acid. The constituents of the steel that might adversely affect the layer quality are trapped by the addition of complex-forming agents.

A further advantageous modification of the invention consists in bringing the workpieces into contact with a phosphating solution that additionally contains 0.2 to 4 g/l of nickel ions or 0.2 to 4 g/l of magnesium ions.

These additions produce an homogenithation of the etching attack on the metal surface to be treated and thereby achieve a stronger adhesion of the phosphate layer. Also the appearance of the phosphate layer is improved as a result of the generally desirable dark coloration. In addition, the content of magnesium ions reduces the overall consumption of chemicals.

Finally, it is expedient to contact the workpieces with a phosphating solution in which at least a proportion of the manganese ions have been replaced by manganese carbonate in order to neutralise the free acid.

The contact of the workpieces with the phosphating solution preferably takes place at a temperature in the range from 75' to 95° C.

The workpieces may be brought into contact with the phosphating solution in any appropriate way, preferably by immersion treatment. Treatment times of, in general, 1 to 15 minutes are appropriate.

As a rule it is necessary to clean the workpieces before the phosphating. Acidic, neutral or alkaline cleaning agents are used for this purpose. In general the workpieces are thoroughly rinsed with water between the cleaning and the phosphating of the workpieces. Particularly after treatment with alkalis and acids, the workpieces should be pre-rinsed in an aqueous slurry of finely divided manganese phosphate in order to promote the formation of particularly uniform finely crystalline layers in the subsequent phosphating.

Phosphate layers having a layer weight of in general 5 to 30 g/m$^2$ can be obtained by means of the method according to the invention.

The phosphate layers produced by the invention may, in a manner known as per se, be lacquered or provided with plastics coatings. In conjunction with corrosion prevention oils, these measures serve to increase the resistance to rust. The main application of the method according to the invention however is in the treatment of workpieces that are exposed to sliding friction. Such workpieces include, for example, axles, gear mechanism parts and pistons of internal combustion engines and compressors.

It is possible by means of the method according to the invention, to produce manganese phosphate layers with average to high layer thicknesses that, nevertheless, have only a very low averaged roughness depth. The roughness depth is ca. 30 to 50% below the values that were hitherto normally obtained. As a result of the low roughness depth the frictional resistance is considerably reduced for workpieces that are subjected to sliding friction. The reduction of the so-called gas time to about half the hitherto usual time indicates that the duration of the etching attack of the phosphating solution, and thus the removal of metal from the workpiece, is considerably reduced. It is assumed that the content of nitroguanidine in the phosphating solution leads to a certain passivation of the metal surface, which however permits a reduced etching attack and/or leads to an earlier start of the layer formation.

The invention is described in more detail with the aid of the following example.

EXAMPLE

Steel cup-shaped tappets were first of all degreased by immersion in a strongly alkaline, aqueous cleansing agent, next rinsed with water, then pre-rinsed in a slurry of finely divided manganese phosphate, and finally phosphated by immersion in a phosphating solution at 80° C. for a duration of ten minutes.

The phosphating solution contained 11.8 g/l of manganese, 0.5 g/l of nickel, 1 g/l of iron(II), 36 g/l of phosphate (calculated as $P_2O_5$)

4.6 g/l of nitrate and 0.36 g/l of citrate (calculated as citric acid).

The total point number of the phosphating solution was 80, and the point number of the free acid was 11 (measured with 60 g of concentrate per 1 l of water). For the determination of the total acid point number and free acid point number, reference should be made to the details given above.

183 g of a concentrate containing 6.45 wt. % of manganese, 0.28 wt of nickel, 0.05 wt. % of iron(II), 19.8 wt. % of $P_2O_5$, 2.5 wt of nitrate and 0.2 wt. % of citric acid, which was made up to one liter with fully deionised water, served as the phosphating solution batch.

Finely crystalline phosphate layers with a layer weight, of 7 g/m$^2$, corresponding to a layer thickness of 3 to 4 μm, and an averaged roughness depth $R_z$ of 1.3 to 2.4 μm, were obtained. The gas time was 2 to 3 minutes.

A comparative test was carried out under identical conditions with the above phosphating solution, which however did not contain nitroguanidine. Phosphate layers were formed which, although being finely crystalline, nevertheless had an averaged roughness depth $R_z$ of 5 to 6 μm. The layer weight was 6 g/m$^2$. The gas time was 6 to 10 minutes.

The invention claimed is:

1. A method comprising applying a manganese phosphate layer to an iron or steel surface of a workpiece by contacting the iron or steel surface with a phosphating solution at a temperature of from 75 to 95° C., wherein the phosphating solution comprises:

11.8 g/l of manganese ions;

0.5 g/l nickel, 1 g/l of iron (II) ions;

36 g/l of phosphate ions calculated as $P_2O_5$;

4.6 g/l of nitrate ions; and 0.36 g/l of citrate calculated as citric acid, and drying the workpiece is to form a manganese phosphate layer on said surface, wherein said manganese phosphate layer has a minimum thickness of 3 to 4 microns and an average maximum roughness depth ($R_z$) of from 1.3 to 2.4 microns; and wherein the phosphating solution is prepared by mixing 183 grams of a concentrate solution to one liter of water, wherein the concentrate solution comprises:

6.45 wt. % of manganese, 0.28 wt of nickel, 0.05 wt. % of iron (II), 19.8 wt. % of $P_2O_5$, 2.5 wt of nitrate and 0.2 wt. % of citric acid.

2. A method according to claim 1, wherein the workpiece is steel and said phosphating solution comprises a complex-forming agent for alloying constituents of the steel.

3. A method according to claim 2, wherein said complex-forming agent is citric acid.

4. A method according to claim 1, wherein said workpiece is subjected to a sliding friction.

5. A method according to claim 1, wherein said workpiece is selected from the group consisting of axles, gear mechanism parts and engine pistons.

* * * * *